US007392745B2

(12) United States Patent
Johansson

(10) Patent No.: US 7,392,745 B2
(45) Date of Patent: Jul. 1, 2008

(54) DEVICE FOR COMBATING TARGETS

(75) Inventor: Nils Johansson, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 567 days.

(21) Appl. No.: 10/312,955

(22) PCT Filed: Jun. 20, 2001

(86) PCT No.: PCT/SE01/01400

§ 371 (c)(1),
(2), (4) Date: Dec. 15, 2004

(87) PCT Pub. No.: WO02/03012

PCT Pub. Date: Jan. 10, 2002

(65) Prior Publication Data

US 2006/0102040 A1 May 18, 2006

(30) Foreign Application Priority Data

Jul. 3, 2000 (SE) ..... 0002494

(51) Int. Cl.
*F42B 12/08* (2006.01)

(52) U.S. Cl. ..... 102/476; 102/475; 102/478

(58) Field of Classification Search ..... 102/476, 102/475, 478

See application file for complete search history.

(56) References Cited

U.S. PATENT DOCUMENTS

| | | | | |
|---|---|---|---|---|
| 4,374,495 | A * | 2/1983 | Thomanek | 102/476 |
| 4,693,182 | A * | 9/1987 | Winblad | 102/476 |
| 6,216,597 | B1 * | 4/2001 | Bredy | 102/476 |
| 6,901,864 | B2 * | 6/2005 | Helander | 102/211 |
| 2004/0094060 | A1 * | 5/2004 | Helander | 102/476 |

FOREIGN PATENT DOCUMENTS

| | | |
|---|---|---|
| DE | 1128345 | 4/1962 |
| DE | 3609865 C1 | 7/1997 |

* cited by examiner

*Primary Examiner*—Troy Chambers
(74) *Attorney, Agent, or Firm*—Connolly Bove Lodge & Hutz LLP

(57) ABSTRACT

An ammunition unit, for combating targets (10) with or without using shaped charge effect, that incorporates an openable or removable and replaceable hull or outer casing (2). The explosive charge in the ammunition unit comprises a charge section (3) with shaped charge function arranged to be able to assume either of two freely selectable positions in the ammunition unit, the first of which enables the charge to exert its shaped charge function and the second of which disables the shaped charge function and enables a different effect to be triggered.

20 Claims, 2 Drawing Sheets

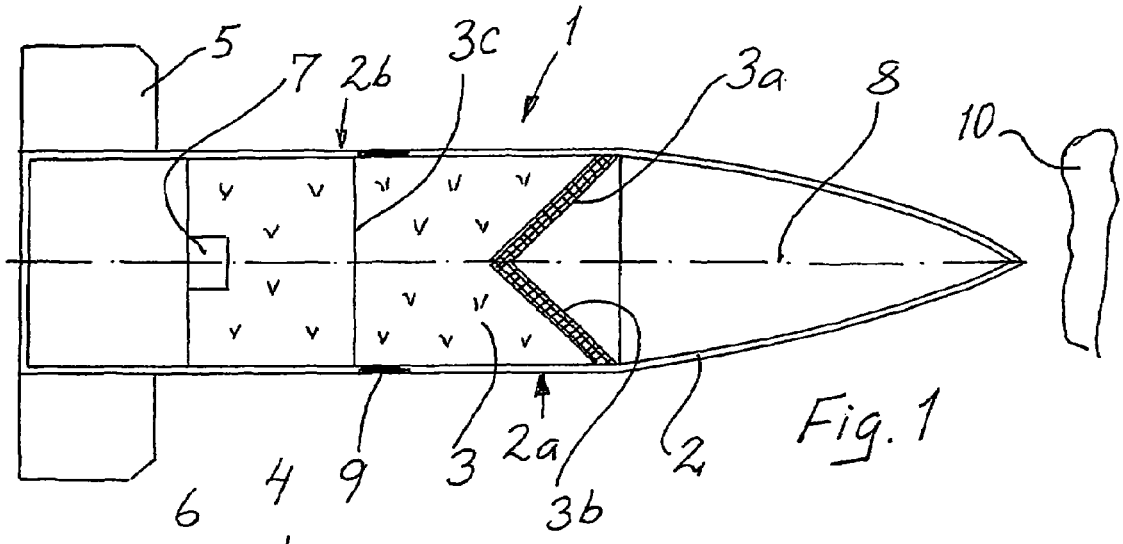
Fig. 1
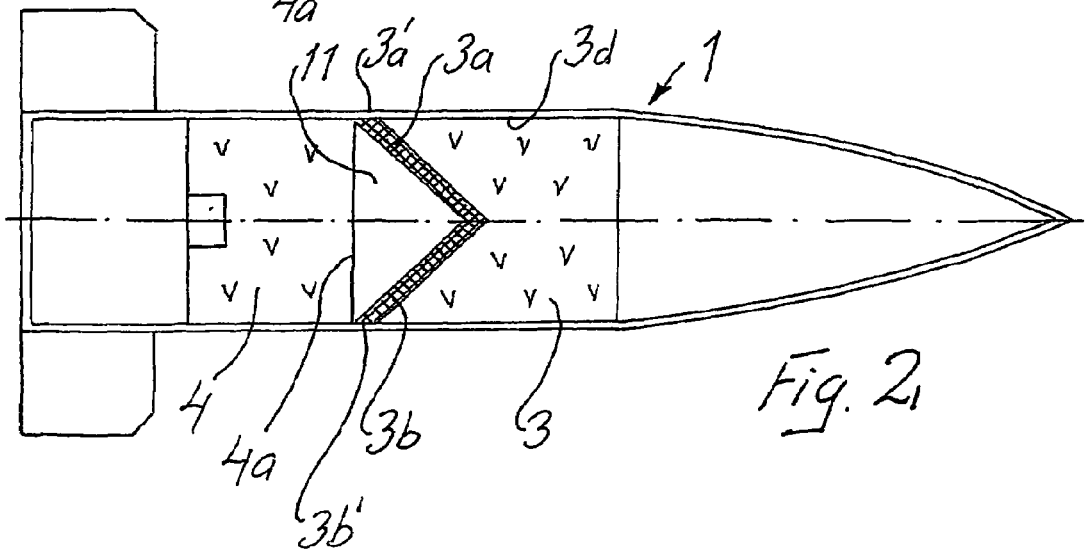
Fig. 2
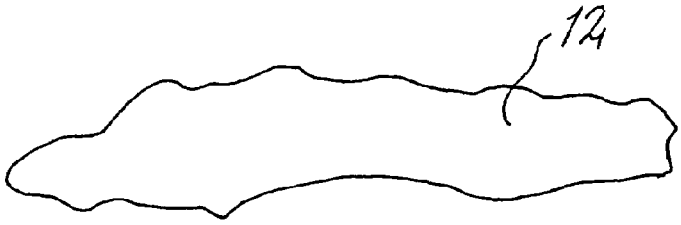

DEVICE FOR COMBATING TARGETS

The present invention relates to a device for combating targets with or without using shaped charge effect. In cases where the above mentioned effect is not used the target is combated using pure pressure effect, for example.

Units of ammunition, e.g. in the form of rounds, shells, projectiles, etc., with or without shaped charge effect exist in extremely large numbers and in a multiplicity of designs. Shaped charge ammunition is used to engage a specific type of target in which a hole needs to be achieved to enable devastating penetration. Units of ammunition with only propelling charge effect or pressure effect are very common and are normally used to combat various types of target.

There is a major need to be able to reduce the wide assortment of natures of ammunition while still being able to fire on different types of target with the desired optimal effect. Thus there is even a desire to be able to combat the said types of targets despite the fact that they require an advanced type of ammunition to achieve at least one of the desired effects in target, namely shaped charge effect.

The purpose of the present invention is to propose a device that resolves the above mentioned problem by proposing that the ammunition in question be easy to adapt to achieve the desired optimal effect in both cases. There is thus an inherent requirement that shaped charge effect, for example, shall not be impaired but shall function equally well as in the case with more dedicated ammunition. The present invention also resolves this problem.

BRIEF DESCRIPTION OF THE DRAWINGS

FIG. 1 is a side cross-sectional view of one embodiment of a device for combating targets according to the present invention, depicting an explosive charge section in a first position;

FIG. 2 is a side cross-sectional view of the embodiment depicted in FIG. 1 depicting the explosive charge section in a second position;

One of the characteristic features of the device in the present invention is that the unit of ammunition, e.g. in the form of a round, shell, projectile, etc., incorporates an openable or removable and closeable hull or outer casing, and that the charge comprises a charge section with shaped charge function. Another feature is that the said charge section is arranged to have two selectable modes in the ammunition unit of which the first mode is to enable the shaped charge function and the second mode is to disable this function. The second mode enables a function to be triggered that is divorced from the shaped charge function and that can consist of a pressure generating function and/or fragmentation effect.

In the designs in the invention concept the charge section in question is arranged to be indexible from the first mode/position to the second, or vice versa, by reversing the charge section 180° in the ammunition unit. In an initial mode for the ammunition unit the charge section can thus assume a shaped charge function and be arranged so that the second mode can be enabled after opening or removal of the hull or outer casing as stated above. Furthermore, the charge section, hereinafter called the first charge section, can interact with another charge section in the ammunition unit hereinafter called the second charge section. In additional designs of the invention concept it is proposed how the interacting faces of the first and second charge sections shall be designed. Reference is hereby made to the subsequent patent claims and the description.

The above proposal enables a number of advantages. The ammunition unit can be switched from one type of ammunition to another, such as for delivery by firing or by dropped release. The ammunition unit can be supplied with a function that is the most common, and can be switched to the other function only when an engagement situation that requires it is encountered. The technical and economic benefits can be retained since switchability between two different engagement situations and indexibility as such do not, as a whole, need to make manufacture, handling and service more expensive.

Figure 3:
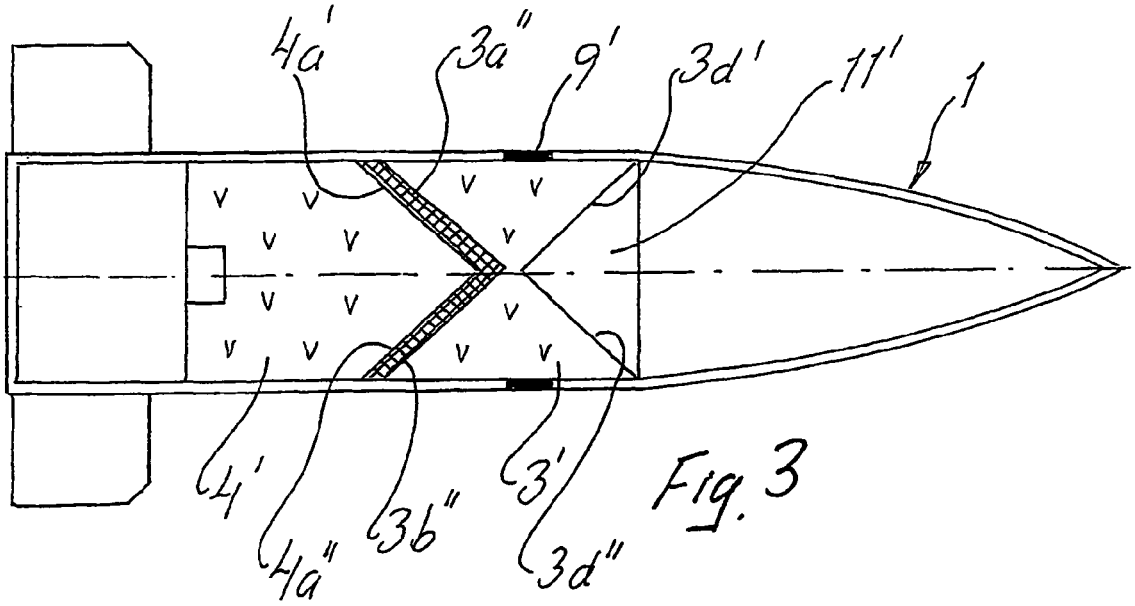
FIG. 3 is a side cross-sectional view of another embodiment of a device for combating targets according to the present invention.
Figure 4:
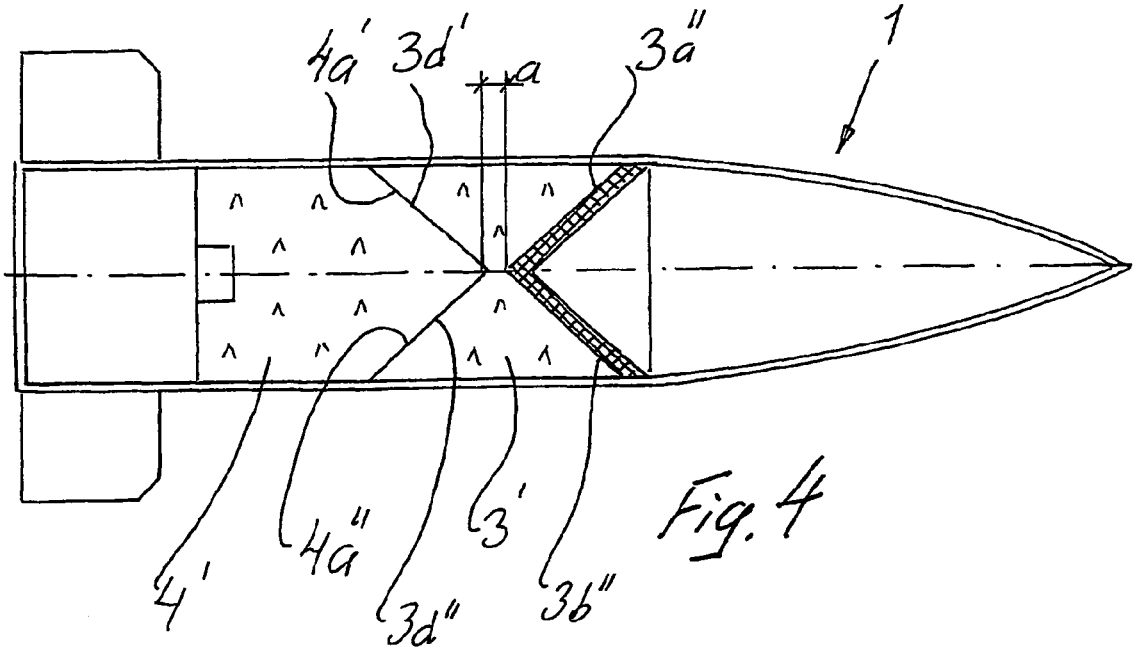
FIG. 4 is a side cross-sectional view of the embodiment depicted in FIG. 3.

A currently proposed design for a device as claimed in the present invention is described below with reference to the appended FIGS. 1-4 in which FIGS. 1 and 2 show an example of an ammunition unit, such as a fin-stabilised or spin controlled projectile, in longitudinal section comprising first and second charge sections where the first section is indexible 180° to enable a shaped charge function in mode one as illustrated in FIG. 1, and to enable a pure pressure effect function as illustrated in FIG. 2, i.e. the shaped charge function is disabled for when the ammunition unit is used, and FIGS. 3 and 4 show another design in longitudinal section of a projectile with two charge sections where the first charge section is in principle indexible 180° for the same purpose as the design illustrated in FIGS. 1 and 2.

In FIG. 1 the ammunition unit is in the form of a shell designated 1. The ammunition unit comprises, in a commonly known manner, a casing 2 containing a charge arrangement with a first charge section 3 and a second charge section 4. This unit is fin- or spin-stabilised by aft fins 5 and is equipped—in an already known manner—with propulsion and guidance devices 6 as well as initiation and detonation devices 7. In the present design example the first charge section 3 consists of a shaped charge. The shaped charge liner designated 3*a*, 3*b* in the present case is in the form of a conical cavity, and the present invention functions in principle for other directions of the said liner 3*a*, 3*b*. Depending on the type of charge (explosive) and the liner 3*a*, 3*b* a forwards directed jet effect can be achieved when the ammunition unit is triggered, which jet effect generally coincides with the longitudinal axis 8 in the direction of fire of the ammunition unit. The second charge section 4 comprises an explosive charge corresponding to the explosive charge in the first charge section 3. The said casing 2 shall be openable or removable by unscrewing to enable the first charge section 3 to be removed from its position/mode shown in FIG. 1 and then to be indexed/reversed 180° to be re-installed in the position/mode shown in FIG. 2. The said openability or removability function can be designed in various ways. In the present invention it is proposed that a screw joint 9 be arranged between front and aft sections, 2*a* and 2*b* respectively, of the casing 2. The screw joint can be comprised of an internal thread in one section and an external thread on the other section, or vice versa. Alternatively, the openability or removability function can be located somewhere else along the length of the casing 2. Openability or removability can also be arranged in some other way, such as by means of a bayonet connector or snap-catch, etc. As illustrated in FIG. 1 the ammunition unit is fired in a conventional manner and activated, also conventionally, in its trajectory adjacent to a target symbolised by 10. When triggered the shaped charge function is activated in an already known manner and attacks the target using the said jet, pressure and/or fragmentation effect.

As illustrated in FIG. 1 the first charge section 3 has a rear face 3*c* that is flat and extends perpendicular to the plane of the figure in FIG. 1. The second charge section 4 has a similar flat, front face 4*a* extending likewise at right angles to the plane of the figure. In the mode illustrated for the charge sections 3 and 4 in FIG. 1 the sections abut on each other via the faces 3*c* and 4*a*. In this way the effect from the explosive in the second charge section 4 can be easily transmitted to the explosive in the first charge section 3.

In FIG. 2 the said face 4*a* of the first charge section 3 abuts on the outer extremities of the said liner 3*a*, 3*b*. The said liner 3*a*, 3*b* incorporates lateral surfaces 3*a*' and 3*b*' which, in principle, coincide with or comprise an extension of lateral surface 3*d*. Because the first charge section has been indexed/reversed the shaped charge function has been disabled for when the ammunition unit 1 is triggered. In this case the ammunition unit operates with the pressure or fragmentation effect obtained when the explosive in the first and second charge sections is initiated. This pressure effect can be used to combat a target like type 12 that is different from target type 10 illustrated in FIG. 1. In the case illustrated in FIG. 2 there is a rear conical space 11 between first and second charge sections 3 and 4 formed by the conical liner 3*a*, 3*b*. The detonation, activation and triggering functions operate in principle in the same way in the different application cases for the first and second charge sections 3 and 4 in FIGS. 1 and 2.

In the version illustrated in FIGS. 3 and 4 the front face 4*a* in FIGS. 1 and 2 has been modified to comprise the conical face designated 4*a*', 4*a*" that interfaces with the cavity formed by the conical liner designated 3*a*", 3*b*". This eliminates the rear space 11 illustrated in FIG. 2. The screw joint 9' or equivalent has been re-located further forwards in relation to the design illustrated in FIG. 1. The rear face of the first charge section 3' similarly comprises a conical cavity designated 3*d*', 3*d*" which, as shown in FIG. 4, interfaces with the conical front face designated 4*a*', 4*a*" of the second charge section 4'.

FIG. 3 illustrates a case where the shaped charge function is disabled and the ammunition unit 1 combats the target by pressure effect (and/or fragmentation effect)—cf. the case illustrated in FIG. 2. FIG. 4 illustrates a case when the shaped charge function is enabled, i.e. facing forwards to enable shaped charge effect when the ammunition unit is triggered. In this case the first charge section 3' is arranged with a distance designated a between the cavity formed by conical face 3*d*' and 3*d*" and the cavity formed by liner 3*a*", 3*b*". The said distance a is filled with the explosive in the first charge section. The effects achieved by the different designs in FIGS. 1 and 2 contra 3 and 4 are essentially the same with the difference being the effect of rear space 11 shown in FIG. 2. The indexibility/reversibility of the first charge section can, in principle, be arranged in some other way. Manual indexing/reversing has been proposed in the above, but automation of this function is feasible. The above mentioned rear space 11 becomes front space 11' after indexing, as shown in FIG. 3.

The present invention is not limited to the design examples illustrated above, but can be subjected to modifications within the framework of the subsequent patent claims and the invention concept.

We hereby claim and desire to secure by Letters Patent the following:

1. A device for combating targets (10, 12) with or without using shaped charge effect, comprising:

an ammunition unit (1) comprising:

an openable outer casing (2);

an explosive charge section disposed within said outer casing; and a shaped charge liner disposed within said explosive charge section, wherein the shaped charge liner is configured to provide the shaped charge effect, and further wherein said explosive charge section is configured to be reversible between one of at least a first position, in which the ammunition unit is enabled to provide the shaped charge effect, and a second position in which the ammunition unit is disabled from providing the shaped charge effect.

2. The device for combating targets of claim 1 wherein the explosive charge section (3) is configured to be reversible between the first and second positions by manually reversing the explosive charge section by 180° in the ammunition unit.

3. The device for combating targets of claim 1 wherein said explosive charge section is initially configured in the first position which enables the shaped charge effect.

4. The device for combating targets of claim 1 wherein said explosive charge section is configured to interact with a second charge section (4).

5. The device for combating targets of claim 4, wherein said explosive charge section further comprises a conical shaped charge liner (3*a*, 3*b*) disposed within said explosive charge section and configured to face forwards in said ammunition unit, wherein said explosive charge section further comprises a rear face (3*c*), and wherein said second charge section (4) further comprises a front face (4*a*), configured to abut said rear face (3*c*) of said explosive charge section when said ammunition unit is enabled to provide the shaped charge effect.

6. The device for combating targets of claim 5, wherein said second charge section comprises a flat front face (4*a*), and wherein said ammunition unit further comprises:

an empty triangular space formed between the conical shaped charge liner (3*a*, 3*b*) and the flat front face (4*a*) of the second charge section (4) when said ammunition unit is configured in the second position such said conical shaped charge liner (3*a*, 3*b*) rests against said flat front face (4*a*) of said second charge section (4).

7. The device for combating targets of claim 1, wherein said outer casing further comprises:

a screw joint (9, 9') configured to allow said openable outer casing to be opened, and further configured to permit manually reversing of said explosive charge section by 180°.

8. The device for combating targets of claim 1, wherein said explosive charge section further comprises a second cavity, wherein the distance (a) between the innermost points of said conical shaped charge liner and said second cavity is small.

9. The device for combating targets of claim 1, wherein the conical shaped charge liner (3*a*, 3*b*) is configured to extend to a lateral surface (3*d*) of the explosive charge section (3), thereby forming an extension of said lateral surface.

10. The device for combating targets of claim 2 wherein said explosive charge section is initially configured in the first position which enables the shaped charge effect.

11. The device for combating targets of claim 2 wherein said explosive charge section is configured to interact with a second charge section (4).

12. The device for combating targets of claim 3 wherein said explosive charge section is configured to interact with a second charge section (4).

13. The device for combating targets of claim 2 wherein said outer casing further comprises:

a screw joint (9, 9') configured to allow said openable outer casing to be opened, and further configured to permit manually reversing of said explosive charge section by 180°.

14. The device for combating targets of claim 3 wherein said outer casing further comprises:

a screw joint (9, 9') configured to allow said openable outer casing to be opened, and further configured to permit manually reversing of said explosive charge section by 180°.

15. The device for combating targets of claim 4 wherein said outer casing further comprises:

a screw joint (9, 9') configured to allow said openable outer casing to be opened, and further configured to permit manually reversing of said explosive charge section by 180°.

16. The device for combating targets of claim 5 wherein said outer casing further comprises:

a screw joint (9, 9') configured to allow said openable outer casing to be opened, and further configured to permit manually reversing of said explosive charge section by 180°.

17. The device for combating targets of claim 6 wherein said outer casing further comprises:

a screw joint (9, 9') configured to allow said openable outer casing to be opened, and further configured to permit manually reversing of said explosive charge section by 180°.

18. The device for combating targets of claim 2 wherein said explosive charge section further comprises a second cavity, wherein the distance (a) between the innermost points of said conical shaped charge liner and said second cavity is small.

19. The device for combating targets of claim 3 wherein said explosive charge section further comprises a second cavity, wherein the distance (a) between the innermost points of said conical shaped charge liner and said second cavity is small.

20. The device for combating targets of claim 4 wherein said explosive charge section further comprises a second cavity, wherein the distance (a) between the innermost points of said conical shaped charge liner and said second cavity is small.

* * * * *